US011266558B2

(12) United States Patent
Villa et al.

(10) Patent No.: US 11,266,558 B2
(45) Date of Patent: Mar. 8, 2022

(54) CONTAINMENT UNIT FOR REDUCING SPREAD OF NASAL/ORAL AEROSOLS

(71) Applicant: The Regents of the University of California, Oakland, CA (US)

(72) Inventors: Alessandro Villa, San Francisco, CA (US); Elena Villa, San Francisco, CA (US)

(73) Assignee: The Regents of the University of California, Oakland, CA (US)

( * ) Notice: Subject to any disclaimer, the term of this patent is extended or adjusted under 35 U.S.C. 154(b) by 0 days.

(21) Appl. No.: 17/163,868

(22) Filed: Feb. 1, 2021

(65) Prior Publication Data

US 2022/0008275 A1 Jan. 13, 2022

Related U.S. Application Data

(60) Provisional application No. 63/048,983, filed on Jul. 7, 2020.

(51) Int. Cl.
*A61G 10/00* (2006.01)

(52) U.S. Cl.
CPC ..... *A61G 10/005* (2013.01); *A61G 2203/78* (2013.01); *A61G 2203/80* (2013.01)

(58) Field of Classification Search
CPC ..... A61G 10/005; A61G 15/00; A61G 15/10; A61B 46/00; A61B 46/10; A61B 46/20
See application file for complete search history.

(56) References Cited

U.S. PATENT DOCUMENTS

| | | | | |
|---|---|---|---|---|
| 3,813,092 | A * | 5/1974 | Foster | A61M 16/0627 5/600 |
| 3,877,691 | A * | 4/1975 | Foster | A61M 16/009 5/600 |
| 4,873,997 | A * | 10/1989 | Marshall | A61B 46/00 128/849 |
| 4,936,318 | A * | 6/1990 | Schoolman | A61G 13/108 128/847 |
| 5,012,852 | A * | 5/1991 | Blackhurst | A61G 15/10 160/351 |
| 5,624,154 | A | 4/1997 | Kishi | |
| 5,865,182 | A * | 2/1999 | Chen | A61B 90/40 128/846 |
| 8,267,147 | B2 | 9/2012 | Lockwood | |
| 8,684,728 | B1 | 4/2014 | Wiesemann | |
| 2004/0007904 | A1 | 1/2004 | Lin et al. | |
| 2014/0216472 | A1 | 8/2014 | Brace et al. | |
| 2017/0281289 | A1 * | 10/2017 | Ahmad | A61B 46/27 |

* cited by examiner

*Primary Examiner* — John P Lacyk
(74) *Attorney, Agent, or Firm* — Edward J. Baba; Shweta Chandra; Bozicevic, Field & Francis LLP

(57) ABSTRACT

Equipment for reducing spread of aerosol and other droplets in nasal and oral airways is provided. The equipment includes a shield optionally combined with a drape. The equipment limits the spread of aerosol and other droplets from a person's mouth and nose thereby reducing the need to decontaminate the procedure room after a procedure. The equipment also provides additional protection to the care-provider conducting the procedure. Additionally, the containment unit also reduces the exposure of the person to pathogens during the procedure, e.g., to pathogens present in the room where procedure is conducted and/or pathogens from the care provider. The equipment or parts thereof may be for single-use or can be reused after disinfection.

13 Claims, 13 Drawing Sheets

9 PVC PLATE DIAM est 110mm DIAM int 100mm - D=5mm

10 HEAT-SEALABLE PVC PLATE DIAM est 150mm DIAM int 110mm - d=1mm

11 WATERPROOF SURGICAL DRAPE TO WELD ON HEAT-SEALABLE PVC

CONTAINMENT UNIT FOR REDUCING SPREAD OF NASAL/ORAL AEROSOLS

CROSS-REFERENCE TO RELATED APPLICATIONS

This application claims benefit under 35 U.S.C. § 119(e) of provisional application 63/048,983, filed Jul. 7, 2020, which is herein incorporated by reference in its entirety.

INTRODUCTION

Reducing spread of pathogens from a person via nasal and oral pathways is important for increasing safety of others exposed to the person. For example, a person undergoing a facial-skin care procedure, dental procedure or surgical procedure may expose others, including, the care provider, health care provider, other patients or staff to pathogen-containing droplets released from the person's oral and nasal pathways and also contaminate the procedure room. Dental procedures cause production of aerosols which are ejected from the patient's mouth. While the dental care provider may be able to use personal protective equipment, such equipment does not prevent contamination of the room where the dental procedure is conducted. In addition, a person receiving care is also exposed to pathogens spread by a care giver. In view of the high risk of infection with SARS CoV-2, expensive and inefficient disinfection protocols requiring clean-up of the entire room are needed.

Thus, there is a need for alternate ways to reduce exposure of health care providers to pathogens present in a patient's oral cavity and airways and reduce dissemination of aerosols and other droplets, produced during dental/surgical procedures, into the surrounding environment.

SUMMARY

Provided herein are containment units for reducing spread of pathogens from a person's oral cavity and/or airways into the surrounding environment and to others. Such units are especially useful in reducing spread of pathogens to health care provider during a procedure that exposes the provider and the surrounding environment to the patient's oral cavity and/or airways. The procedure can be any procedure that increases the amount of a pathogen being released from a person infected by the pathogen. Such procedures include dental and other procedures which enhance production of aerosols and droplets from the patient's fluids, including saliva, phlegm, mucus, and the like. Aerosol production is especially increased by dental procedures employing drilling instruments, high pressure washing, flossing and the like. In addition, the containment unit also reduces the exposure of the patient to pathogens during the procedure, e.g., to pathogens present in the room where procedure is conducted and/or pathogens from the care provider.

The containment unit includes a shield which can optionally be combined with a drape. The containment unit limits the spread of aerosol and other droplets from a patient's mouth thereby reducing the need to decontaminate the procedure room after the dental procedure and protect patients. The shield and/or the drape may be for single-use or can be reused after disinfection.

DEFINITIONS

Figure 1A:
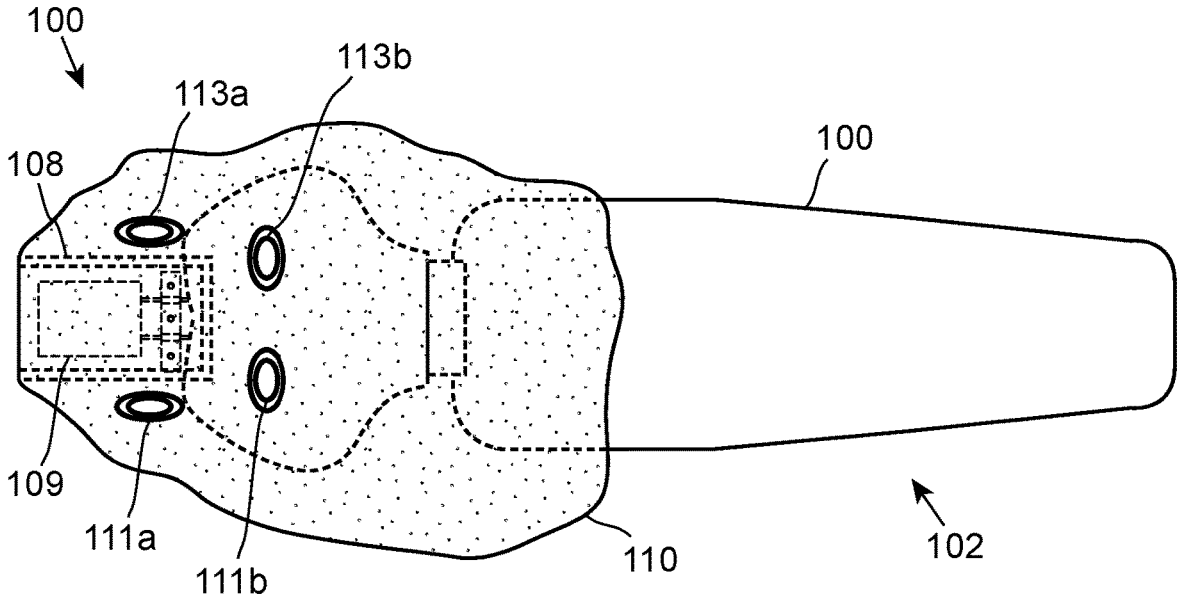
FIGS. 1A-1E illustrate various containment units provided herein.

Provided herein are containment units for reducing spread of pathogens from a person's oral cavity and/or airways into the surrounding environment and to others. Such units are especially useful in reducing spread of pathogens to health care provider during a procedure that exposes the provider and the surrounding environment to the patient's oral cavity and/or airways. The procedure can be any procedure that increases the amount of a pathogen being released from a person infected by the pathogen. Such procedures include dental and other procedures which enhance production of aerosols and droplets from the patient's fluids, including saliva, phlegm, mucus, and the like. Aerosol production is especially increased by dental procedures employing drilling instruments, high pressure washing, flossing and the like. In addition, the containment unit also reduces the exposure of the patient to pathogens during the procedure, e.g., to pathogens present in the room where procedure is conducted and/or pathogens from the care provider.

The containment unit includes a shield which can optionally be combined with a drape. The containment unit limits the spread of aerosol and other droplets from a patient's mouth thereby reducing the need to decontaminate the procedure room after the dental procedure and protect patients. The shield and/or the drape may be for single-use or can be reused after disinfection.

Before the present invention is further described, it is to be understood that this invention is not limited to particular embodiments described, as such may, of course, vary. It is also to be understood that the terminology used herein is for the purpose of describing particular embodiments only, and is not intended to be limiting, since the scope of the present invention will be limited only by the appended claims.

Where a range of values is provided, it is understood that each intervening value, to the tenth of the unit of the lower limit unless the context clearly dictates otherwise, between the upper and lower limit of that range and any other stated or intervening value in that stated range, is encompassed within the invention. The upper and lower limits of these smaller ranges may independently be included in the smaller ranges, and are also encompassed within the invention, subject to any specifically excluded limit in the stated range. Where the stated range includes one or both of the limits, ranges excluding either or both of those included limits are also included in the invention.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, the preferred methods and materials are now described. All publications mentioned herein are incorporated herein by reference to disclose and describe the methods and/or materials in connection with which the publications are cited.

The publications discussed herein are provided solely for their disclosure prior to the filing date of the present application. Nothing herein is to be construed as an admission that the present invention is not entitled to antedate such publication by virtue of prior invention. Further, the dates of publication provided may be different from the actual publication dates which may need to be independently confirmed.

DETAILED DESCRIPTION

Provided herein are containment units for reducing spread of pathogens from a person's oral cavity and/or airways into the surrounding environment and to others. Such units are especially useful in reducing spread of pathogens to health care provider during a procedure that exposes the provider and the surrounding environment to the patient's oral cavity and/or airways. The procedure can be any procedure that increases the amount of a pathogen being released from a person infected by the pathogen. Such procedures include dental and other procedures which enhance production of aerosols and droplets from the patient's fluids, including saliva, phlegm, mucus, and the like. Aerosol production is especially increased by dental procedures employing drilling instruments, high pressure washing, flossing and the like. In addition, the containment unit also reduces the exposure of the patient to pathogens during the procedure, e.g., to pathogens present in the room where procedure is conducted and/or pathogens from the care provider.

The containment unit includes a shield which can optionally be combined with a drape. The containment unit limits the spread of aerosol and other droplets from a patient's mouth thereby reducing the need to decontaminate the procedure room after the dental procedure and protect patients. The shield and/or the drape may be for single-use or can be reused after disinfection.

In certain embodiments, the containment unit comprises a transparent shield sized to fit over a person's face and enclose a space above the person's face which space is sufficient to accommodate at least two, at least three hands, or at least four hands, e.g., up to 6 hands and at least a facial-skin care/surgical/dental instrument. The shield may include a proximal end and a distal end, a first edge and a second edge extending from the proximal end to the distal end, a surface extending between the proximal and distal ends and between the first and second edges, wherein the proximal end, and the first and second edges define a periphery of the shield and wherein the distal end of the shield is attached to a shield-positioning assembly.

In some instances, the containment unit also includes a drape attachable along the periphery of the shield and sized to cover at least the torso of the person. The drape comprises at least two access areas, wherein each of the access areas is sized to accommodate passage of a hand and a skin care/surgical/dental instrument and is located at one side of the drape so as to allow for both hands to access a side of the person's face.

In certain embodiments, when viewed from the front/side, the surface of the shield is L-shaped with a curved corner, or the surface of the shield is L-shaped with a curved corner and with substantially symmetrical regions on both sides of the curved corner, or the surface of the shield is C-shaped, the surface of the shield is a combination of a C-shape and an L-shape such that the surface is curved towards the distal end and substantially flat towards the proximal end, or the shield is substantially flat. Front/side view refers to the view from which only the first edge or the second edge are visible. A top view refers to a view where both the first and second edges are visible.

In certain embodiments, the surface of the shield is a combination of a C-shape and an L-shape with a curved corner, and comprising a distal region extending from the distal end to the corner and a proximal region extending from the corner to the proximal end. The distal region having a curved surface and the proximal region having a flat surface. In certain embodiments, the surface of the shield is L-shaped with a curved corner and comprising a substantially flat distal region and a substantially flat proximal region. When viewed from the side, the shield may have a height, measured from the distal end to the plane defined by the proximal end, of about 250 mm-about 350 mm, e.g., 280 mm-350 mm, 250 mm-330 mm, or 250 mm-300 mm. The proximal and distal ends may be substantially linear and may have a width of about 120 mm-350 mm, e.g., 150 mm-350 mm, 150 mm-300 mm, 150 mm-270 mm, or 150 mm-210 mm. The first and second edges may be substantially parallel.

Aerosols, as used herein, encompass both solid particles and liquid droplets floating in air. The use of the containment unit described herein may reduce the spread of the aerosols by about at least 10%, at least 20%, at least 30%, at least 40%, at least 50%, at least 60%, at least 70%, at least 80%, at least 90%, or more as compared to the spread in absence of use of the containment unit. As used herein, the term "surgical/dental instrument" refers a surgical instrument or a dental instrument that are routinely used during surgical procedure or dental procedure, respectively. As used herein, the term "skin care instrument" refers to an instrument used for skin care, e.g., suction wand, cleansing brush, etc. The size of the access regions is sufficient to allow placement of at least a part of the instrument in a patient's mouth or airway or on a person's face.

The shield may be made from plastic, glass, plexiglass or another transparent material which may have anti-fogging properties. The inner surface of the shield may be sprayed with a material that reduces fogging of the surface of the shield. The outer surface of the shield may be sprayed with an anti-reflective material to reduce glare from the outer surface of the shield.

In certain embodiments, the shield is fixedly attached to the shield-positioning assembly. The shield-positioning assembly may include a first hinge and an attachment unit. The distal end of the shield may be fixedly attached to the first hinge and the attachment unit may attach the first hinge to the head rest of a dental chair or a surgical table.

In some instances, the shield is fixedly attached to an articulating arm. As used herein, the term "articulating arm" refers to a flexible elongated member having both the flexibility to be placed in particular configuration while having sufficient rigidity to maintain the position and to support the shield. The articulating arm can include flexible joints covered partially or entirely by a smooth cover that is easy to clean. The articulating arm can include an attachment means, e.g., a suction pad or a clamp for attaching to a headrest or backrest of a chair to enable placement of the shield over the face of a person sitting/laying in the chair. The attachment means may be present at a distal end of the arm and the shield attached to the proximal end.

In some instances, the articulating arm is fixedly attached to a platform at the distal end and attached to the shield at the proximal end. The platform can include a telescoping arm to adjust the height of the shield. Thus, the distal end of the articulating arm may be attached to the telescoping arm supported by the platform. The platform may be made of any suitable material and may include a heavy base to prevent the shield from tipping. In some cases, the platform may include a flat base positioned on wheels.

As used herein, the terms dental chair and surgical table refer to the standard dental chairs and surgical tables used in the field. The term head rest refers to the region of the dental chair or surgical table where the patients' head is positioned when the patient is on the chair/table.

In certain embodiments, the first hinge is configured for rotation about a Y-axis such that the shield is positioned in an open configuration when flipped up or in a closed configuration over a patient's face when flipped down. Y-axis refers to the axis extending from the first side edge to the second side edge of the shield such that the shield rotates at the distal end.

In certain embodiments, the attachment unit comprises a first plate sized to position the distal end of the shield adjacent the top end of the head rest area of the dental chair or surgical table such that the patient's head is enclosed by the surface of the shield and the drape when the drape is attached to the shield.

In certain embodiments, the plate comprises a second hinge attached to the first hinge, wherein the second hinge is rotatable about an X-axis and is configured to move the shield and the first hinge to either the left side or the right side of the dental chair or surgical table.

In certain embodiments, the attachment unit further comprises a second plate configured for attaching the first plate to a region behind the head rest area of the dental chair or surgical table. In other embodiments, the first plate is attached directly to the head rest by, e.g., welding or using screws.

In certain embodiments, the shield is slidably attached to the shield-positioning assembly, wherein the shield-positioning assembly comprises a pair of parallel guide rails configured to slidably support the shield, wherein each of the guide rails enclose a space sized to fit the length and thickness of the shield. The guide rails may be attached to the head rest area of a dental chair or a surgical table. The guide rails may be attached to the head rest area of a dental chair or a surgical table via a hinge that allows for movement of the guide rails to a position over the dental chair or a surgical table when the guide rails are flipped down.

In certain embodiments, the shield is fixedly attached to a movable cart, wherein the movable cart is sized to fit under a dental chair or surgical table such that the shield is positioned above the dental chair or surgical table when the cart is moved to a position under the dental chair or surgical table.

In certain embodiments, the containment unit includes a drape. In some instance, the drape comprises a first pair of access areas and a second pair of access areas, where the first pair of access areas is located at a right side of the drape so as to allow for both hands to access the right side of the patient's face and the second pair of access areas is located at a left side of the drape so as to allow for both hands to access the left side of the patient's face.

In certain embodiments, the drape comprises a proximal end comprising a cut-out shaped to match the shape of the periphery of the shield. The cut-out may be rectangular in shape and the periphery of the shield may be rectangular, or the cut-out may be square in shape and the periphery of the shield may be square in shape, or the cut-out may be oval in shape and the periphery of the shield may be oval in shape.

In certain embodiments, the cut-out region comprises an adhesive surface for attaching the drape to the shield. In other embodiments, another type of attachment may be utilized. The drape may be sized to extend from the shield to at least the side edges of the dental chair or the surgical table. In certain embodiments, the drape may be sized to extend from the shield to the floor and covering at least a top half of the dental chair or the surgical table. In certain embodiments, the drape may be sized to extend from the shield to the floor and cover substantially the entire dental chair or the surgical table. The drape may have a surface area of about 49 $ft^2$ to about 12 $ft^2$, e.g., about 49 $ft^2$ to about 16 $ft^2$, about 49 $ft^2$ to about 24 $ft^2$, about 42 $ft^2$ to about 24 $ft^2$, 42 $ft^2$ to about 16 $ft^2$, such as, about 42 $ft^2$, about 35 $ft^2$, about 30 $ft^2$, about 24 $ft^2$, or about 16 $ft^2$.

In certain embodiments, the shield is not operably connected to a suction means for suctioning out air and any fluids present within the shield. In certain embodiments, the drape is not operably connected to a suction means for suctioning out air and any fluids present within the containment unit.

In certain embodiments, the drape is operably connected to a suction means for suctioning out air and any fluids present within the containment unit. In certain embodiments, the suction means comprises means for pumping fresh air into the containment unit.

Suction means refers to an air pump that can take up air and release the air to an exhaust or another containment area. The suction means may include a filter to capture the aerosols or other droplets.

In certain embodiments, the lack of a suction means substantially reduces the cost of the containment unit. In certain embodiments, the containment unit while not being connected to a suction means may be connected to a fan or a similar device for providing movement of air within the containment unit.

Specific embodiments of the devices disclosed herein are illustrated in FIGS. 1-6.

Figure 1B:
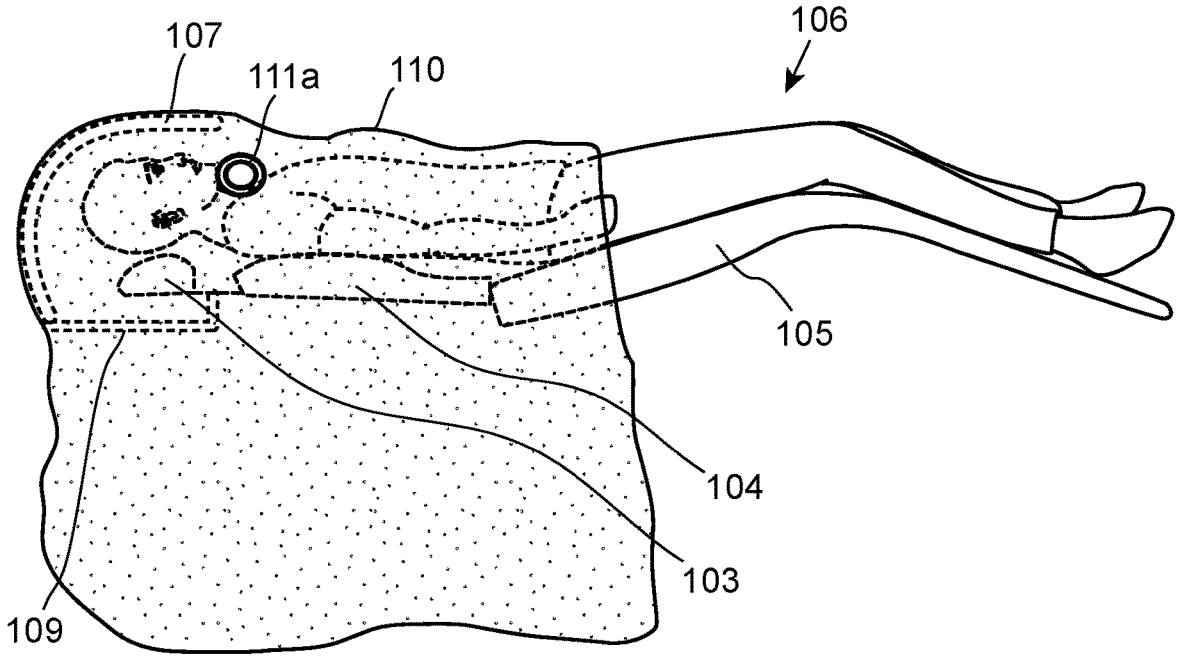
Figure 1C:
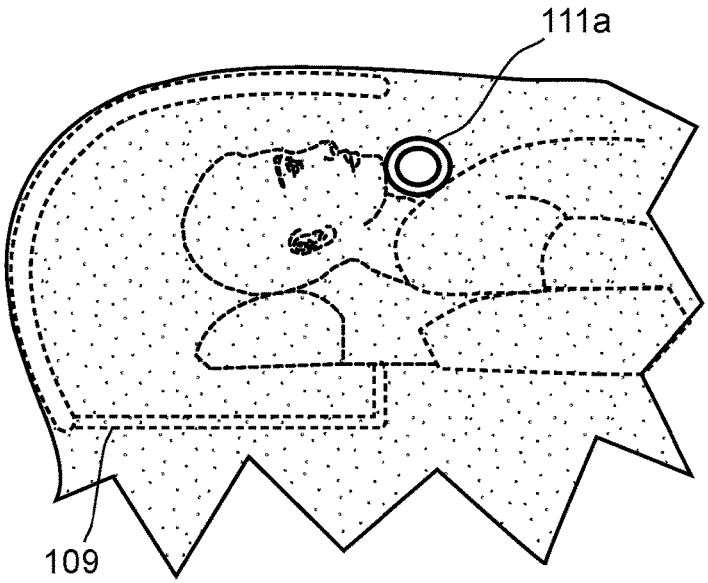

FIGS. 1A-1C show a schematic of a protective equipment 100 of the present disclosure. The terms protective equipment, device, and containment unit are used herein interchangeably to refer to the containment unit described herein. A dental chair 102 with a head rest 103, a torso supporting section 104, and a lower body supporting section 105 is depicted. A schematic of a patient 106 showing relative placement of the head 107 of the patient and the protective equipment comprising shield 108, shield attachment means 109, and drape 110 is shown. The drape 110 includes access areas 111*a*; 111*b* and 113*a*; 113*b* for allowing placement of a care provider's hands adjacent a patient's face.

Figure 1D:
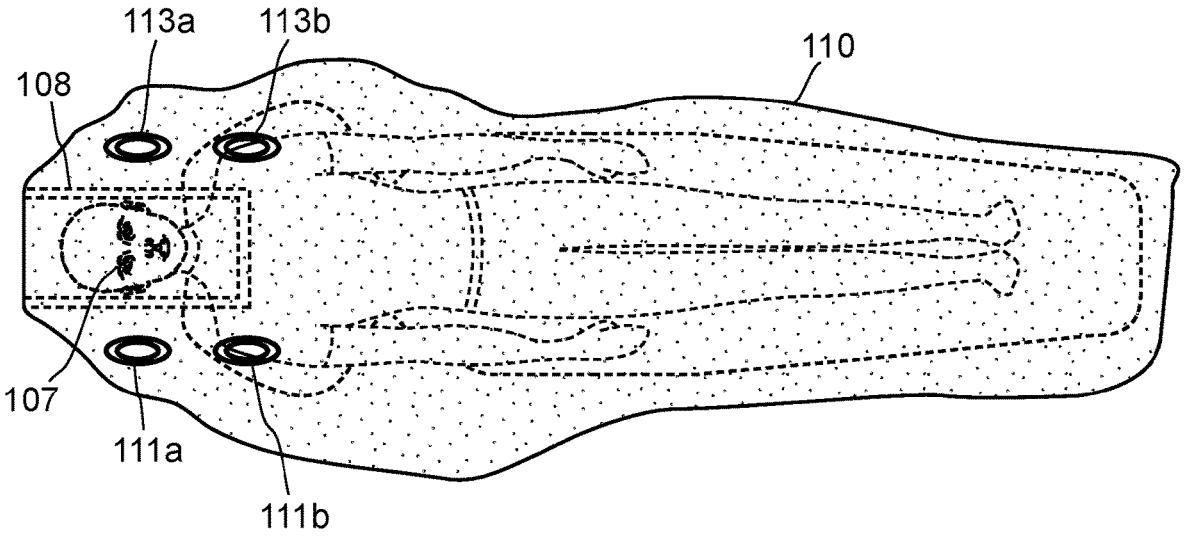
Figure 1E:
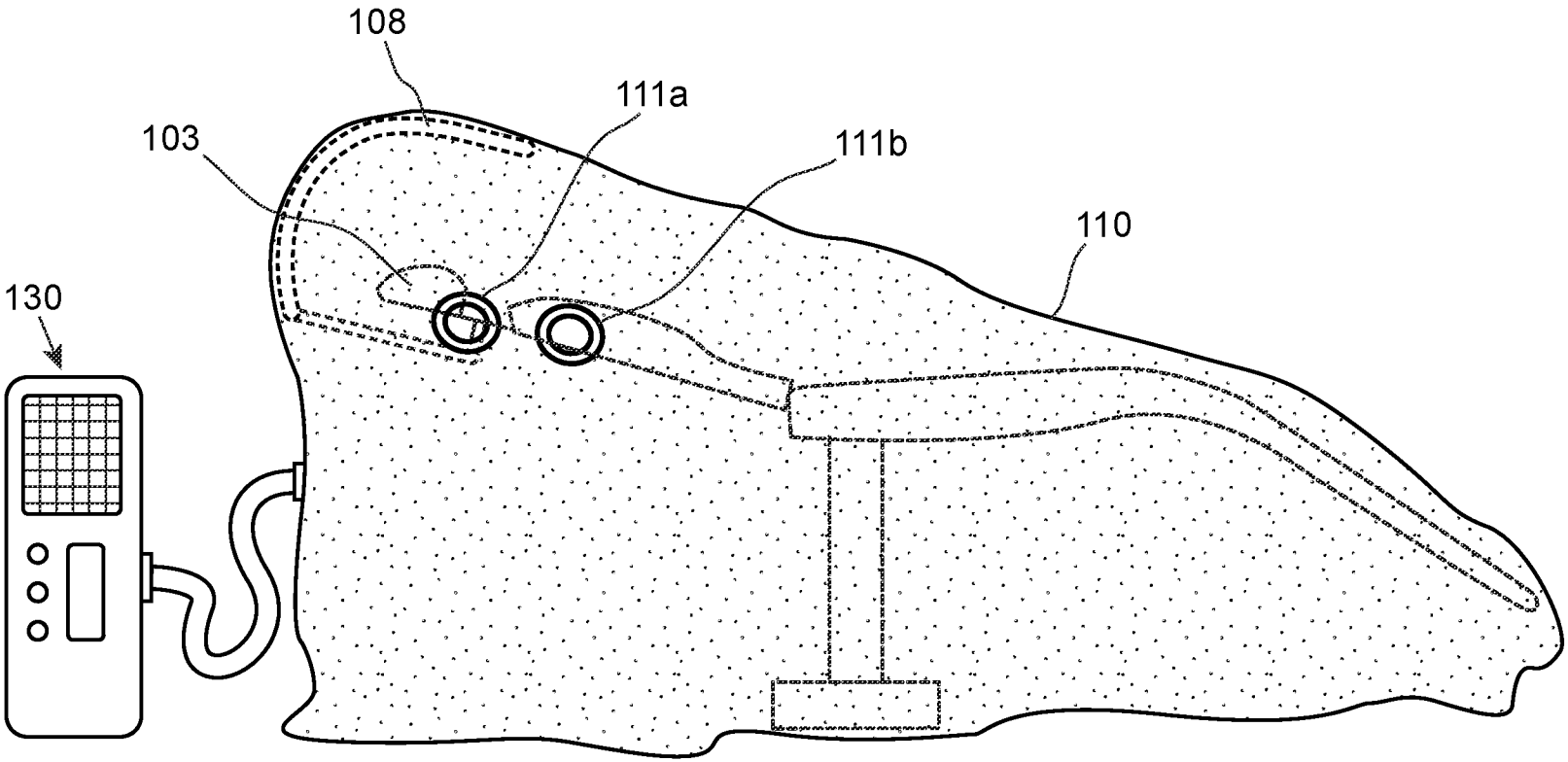

FIG. 1A provides an overhead view and FIGS. 1B and 1C provide a side/front view showing the shield 108 positioned over the head 107 of the patient and drape 110 covering sides of the face not covered by the shield as well as the torso of the patient. A first pair of access areas 111*a* and 111*b* allow access to the right side of the patient's face. A second pair of access areas 113*a* and 113*b* allow access to the left side of the patient's face. In certain embodiments, the drape may only include one pair of access areas. In certain embodiments, the drape may be of a size sufficient to cover the torso of the patient and extend below the dental chair, as shown in FIG. 1B. In certain embodiments, the drape 110 may be of a size sufficient to cover the entire dental chair as shown in FIG. 1D. In other embodiments, the drape 110 may be of size sufficient to cover the entire dental chair and extend down to the floor as shown in FIG. 1E.

Figure 2A:
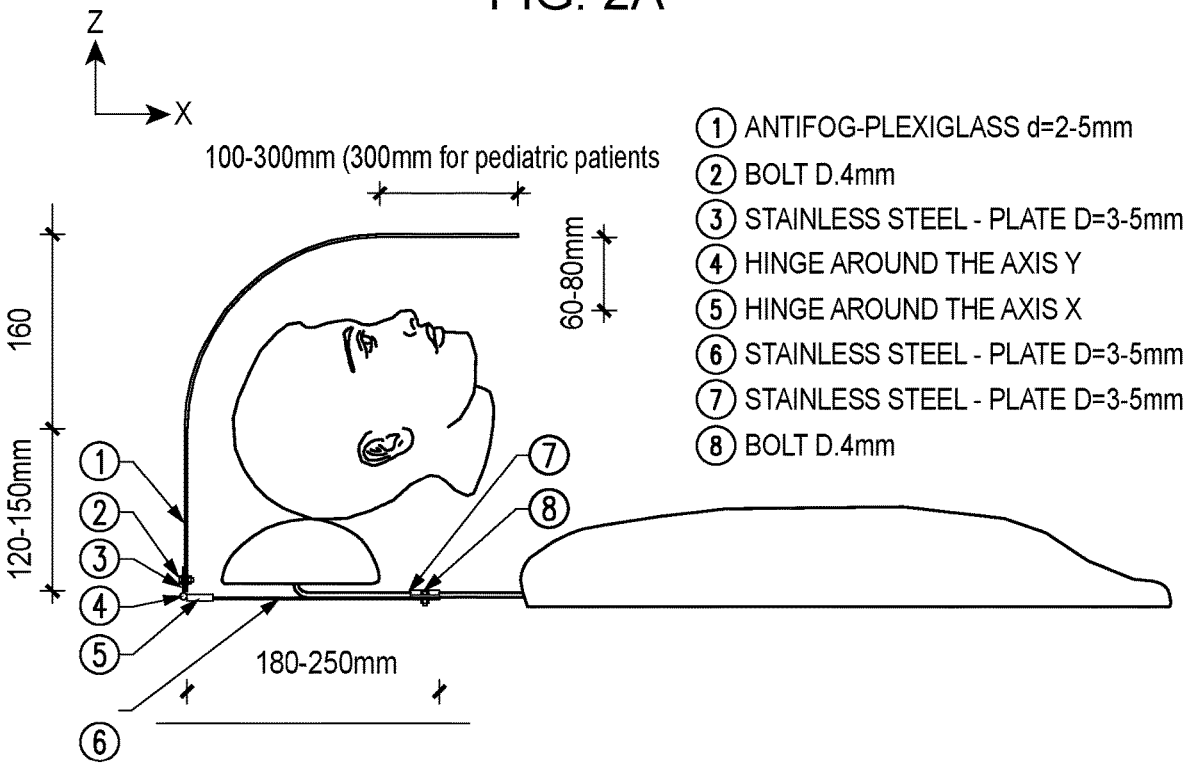
FIGS. 2A-2B provide a detailed view of a shield and a shield-positioning assembly according to an embodiment of a containment unit provided herein.

FIG. 2A shows a front/side view of a shield portion of a device encompassed by the present disclosure. The shield includes two substantially flat regions connected by a curved region. The portion of the first flat region of the shield attachable to a hinge structure is referred to herein as the distal region of the shield which distal region is shown as attached to a plate 6 at the distal end. Plate 6 is attached to the dental chair via plate 7 and bolts 8. The shield may be made from plexiglass or another transparent material which may have anti-fogging properties. The distal region is attached to plate 6 via plate 3 which is connected to hinge structure 4 rotatable around the Y-axis and to hinge structure 5 rotatable around the X-axis. Bolts 2 attaches shield 1 to plate 3 which includes hinge structure 4. Hinge structure 5 may be present on plate 6.

The shield may have a height of about 280 mm-about 310 mm as measured from the distal end to the second flat region and a length of about 200 mm-about 600 mm as measured from the distal end to the proximal end which is the end of the second flat region. The substantially flat regions may have a length of about 120 mm-150 mm on the distal side of the shield as measured from the distal end to the start of the curved region and a length of about 100-300 mm on the proximal side of the shield as measured from the end of the curved region to the proximal end. The shield may be sized to provide a clearance between the patient's mouth and the shield which clearance has a height of about 60 mm-80 mm. The length of plate 6 used to connect hinge structure 4 to plate 7 may be chosen based upon the dental chair design to accommodate difference in sizes of the dental chairs. In certain embodiments, the plate 6 may have a length of about 180-250 nm.

The thickness of the shield and plates may vary depending on the type of materials and may be chosen to provide sufficient structural support while being cost effective. In certain embodiments, the shield may have a thickness in the range of about 2-5 mm. The plates may have a thickness in the range of about 3-5 mm. The bolts may have a diameter of about 0.4 mm.

Figure 2B:
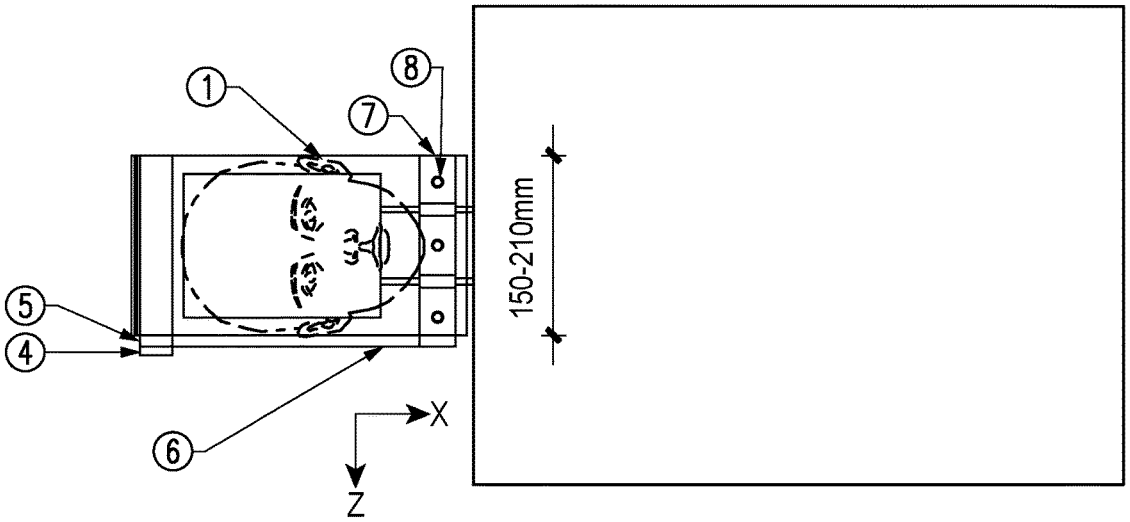

FIG. 2B shows a top view of the shield 1. The shield depicted in the figure has a width of about 150 mm-210 mm. The shield may have a width of up to 350 mm. Hinge structures 4 and 5 are also depicted as are the plates 6 and 7 and bolts 8 that attach plate 7 to the dental chair.

Figure 3A:
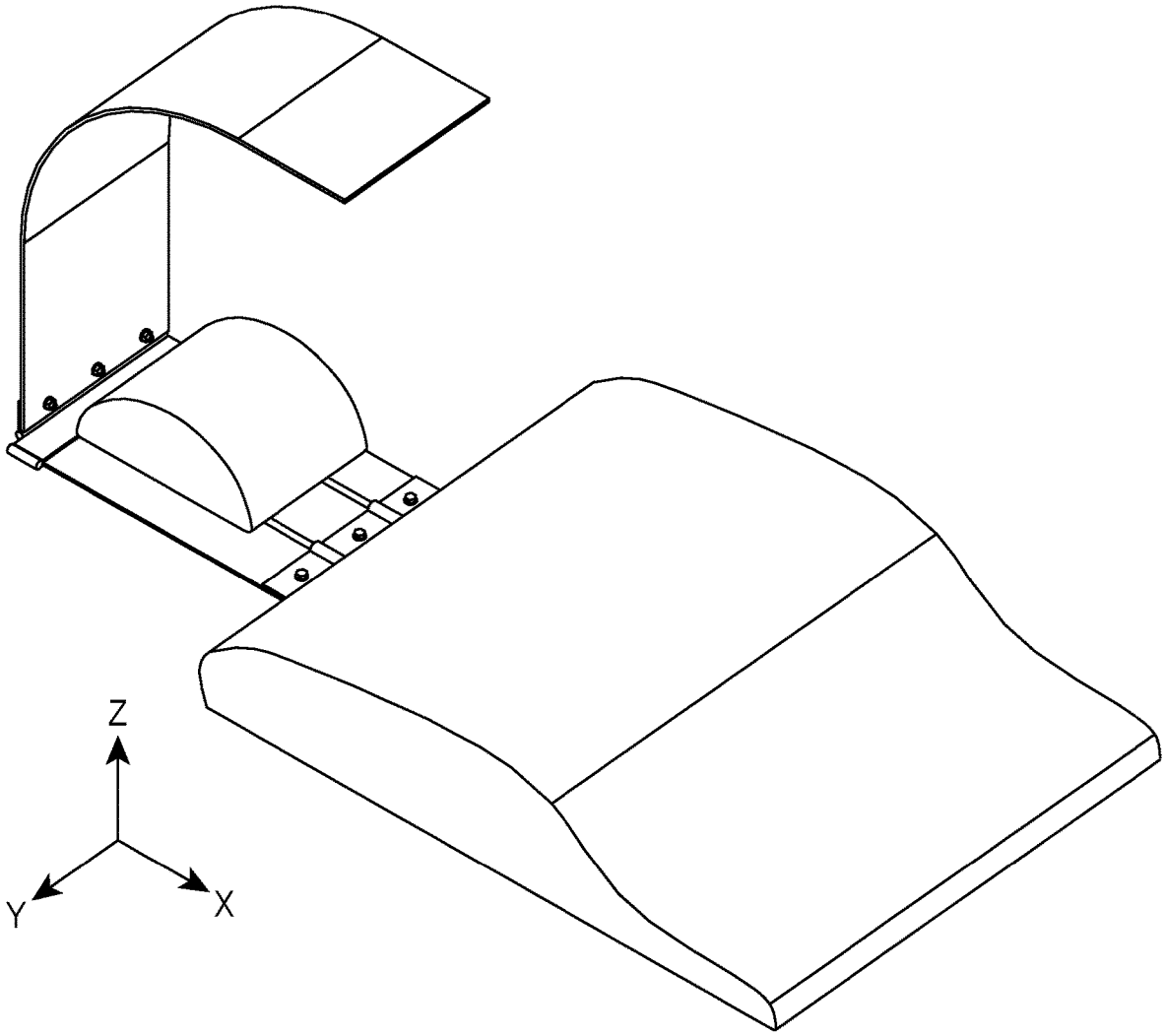
FIGS. 3A-3D provide three-dimensional (3D) views of a shield and a shield-positioning assembly attached to the head rest of a dental chair.
Figure 3B:
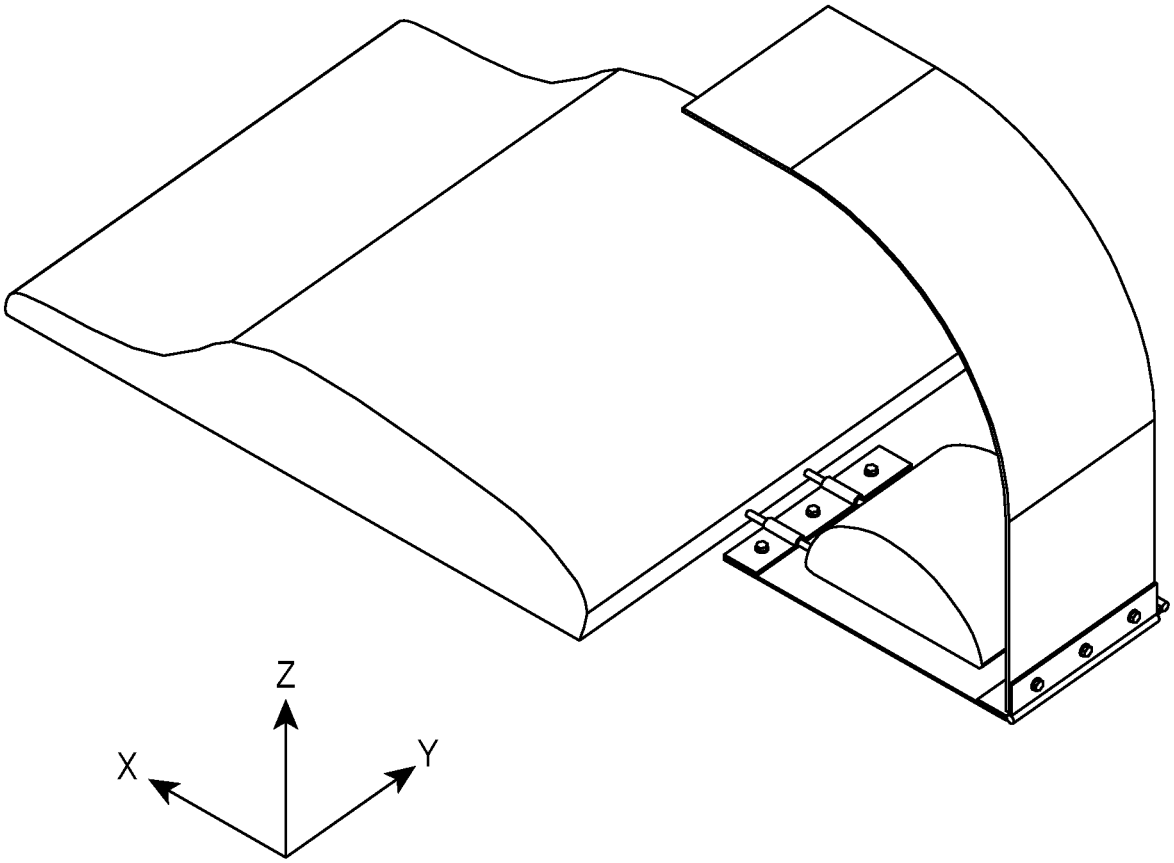

FIGS. 3A and 3B show a 3D view of the shield attached to the back of the headrest of the dental chair and flipped down via a downward motion that rotates the shield about the Y-axis using the hinge structure 4.

Figure 3C:
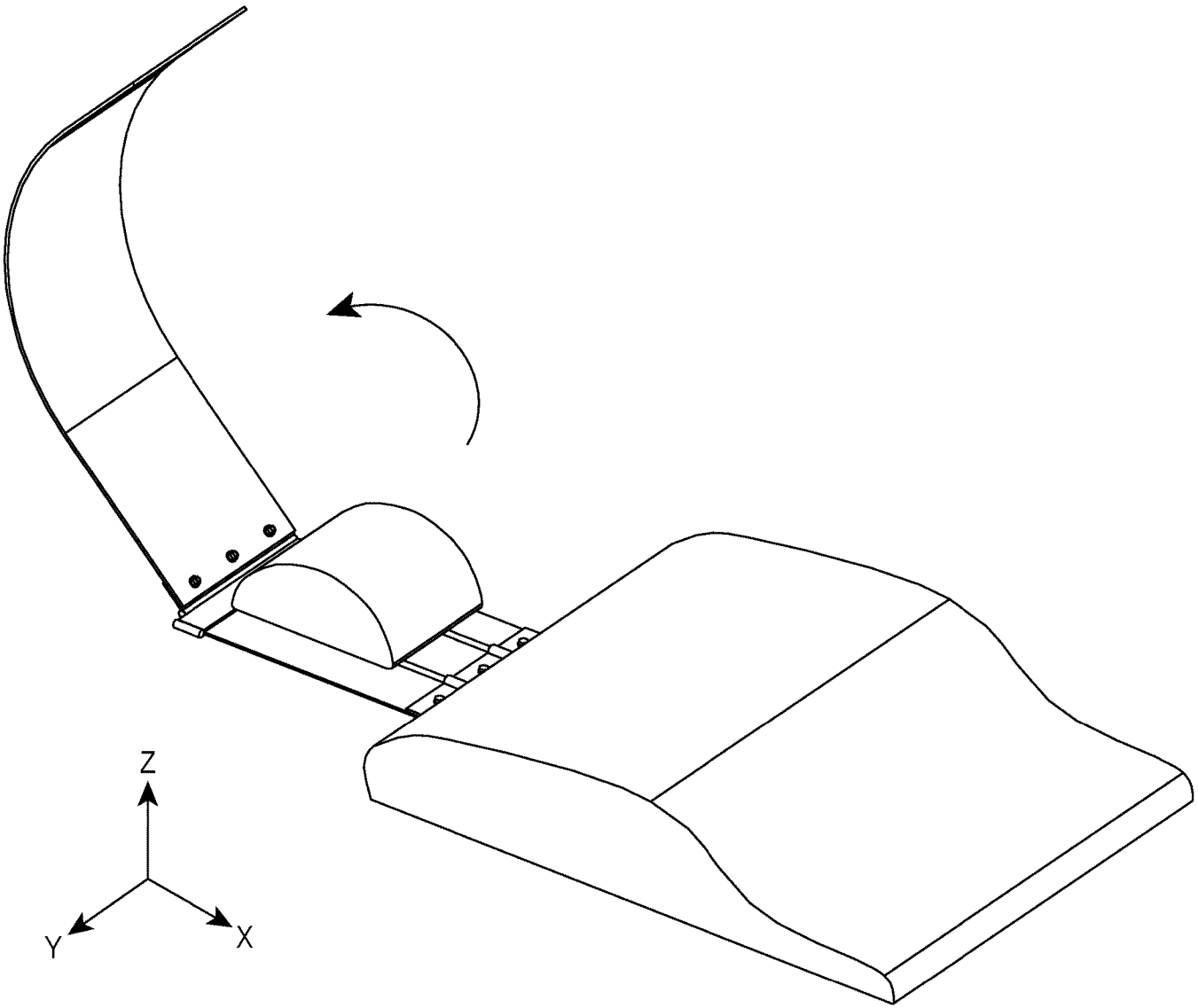
Figure 3D:
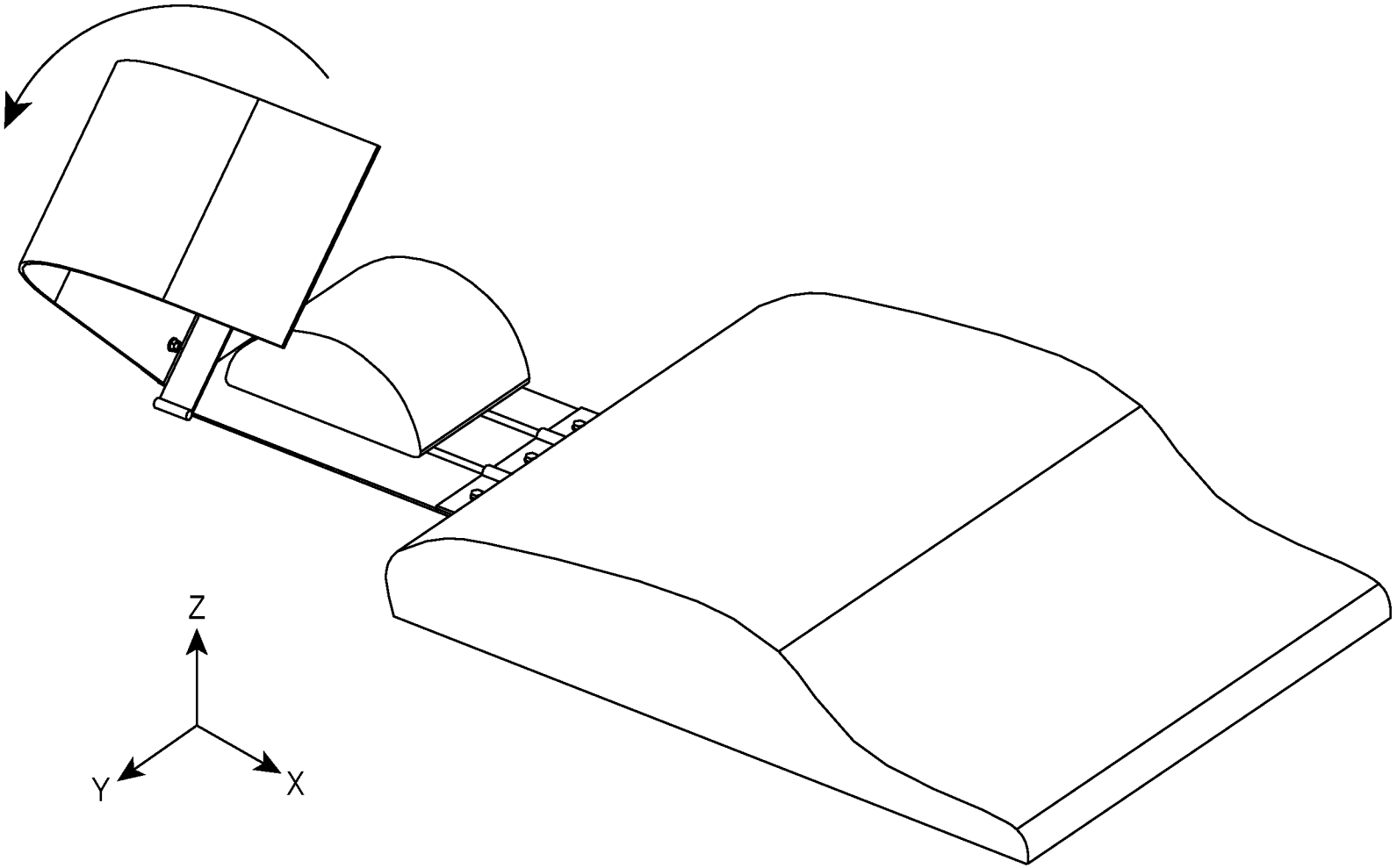

FIGS. 3C and 3D provide 3D views showing movement of the shield. In FIG. 3C, the shield is moved to a flipped open position by rotating the shield up about hinge structure 4. In FIG. 3D, the shield is moved to a side position by rotating the shield about the hinge structure 5 around the X-axis.

In certain embodiments, the device may include a shield that is attached to a dental chair and include a single hinge structure. In certain embodiments, the single hinge structure allows rotation about the Y-axis and may allow flipping up of the shield to allow a patient to lay on the dental chair and flipping down of the shield onto the patient's face. In certain embodiments, the single hinge structure may allow rotation about the X-axis and may allow flipping the shield to one side to allow a patient to lay on the dental chair and to flipping back in position over the patient's face. The single hinge structure that allows rotation about the X-axis may be positioned on either side of plate 6 such that it may be flipped open on the right or the left side of the patient. The placement of the single hinge structure 5 can be chosen based upon the orientation in which the dental chair is placed in a room.

Figure 4:
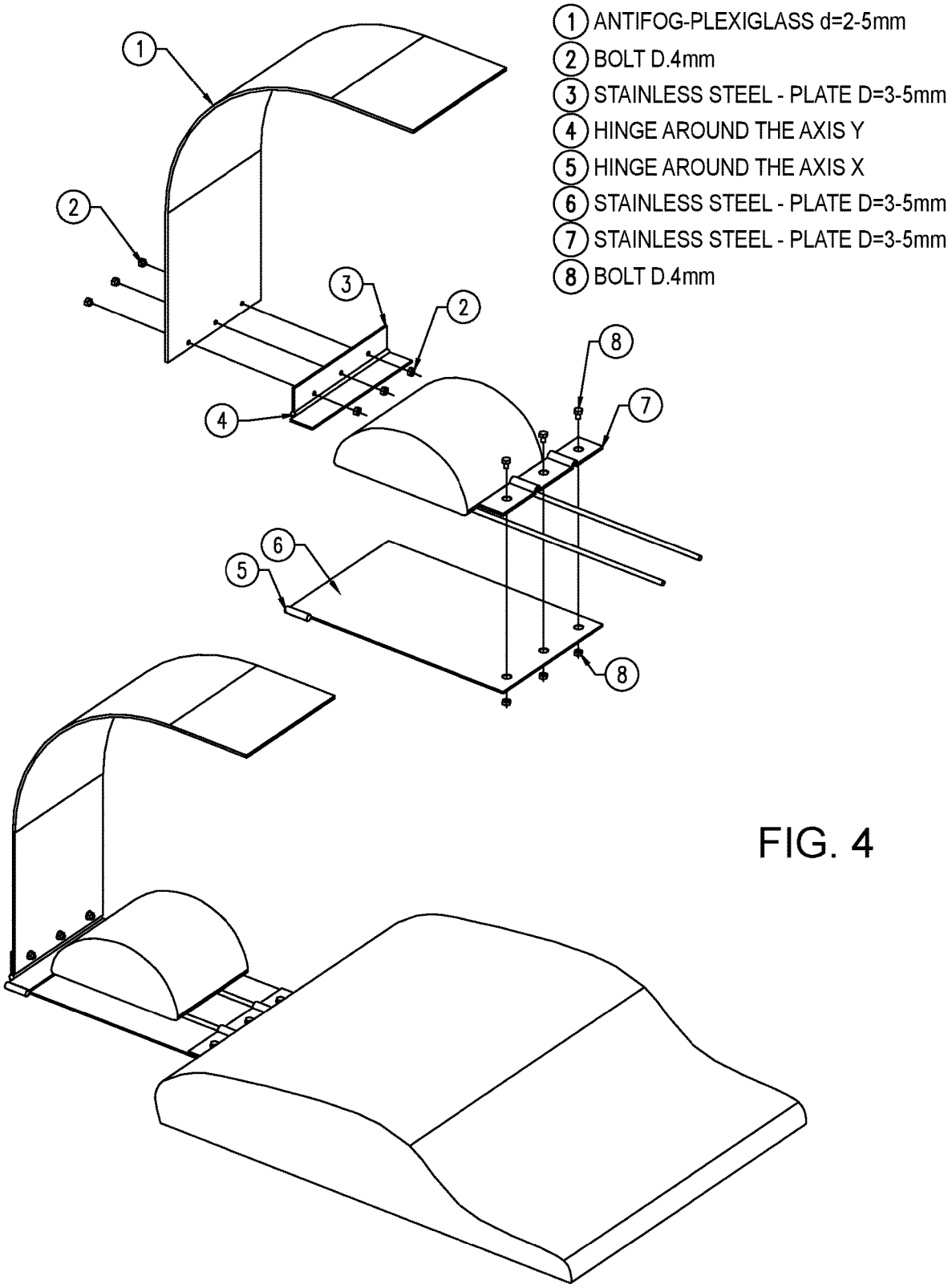
FIG. 4 provides an exploded axonometric view of a shield-positioning assembly according to an embodiment of a containment unit provided herein.
Figure 5:
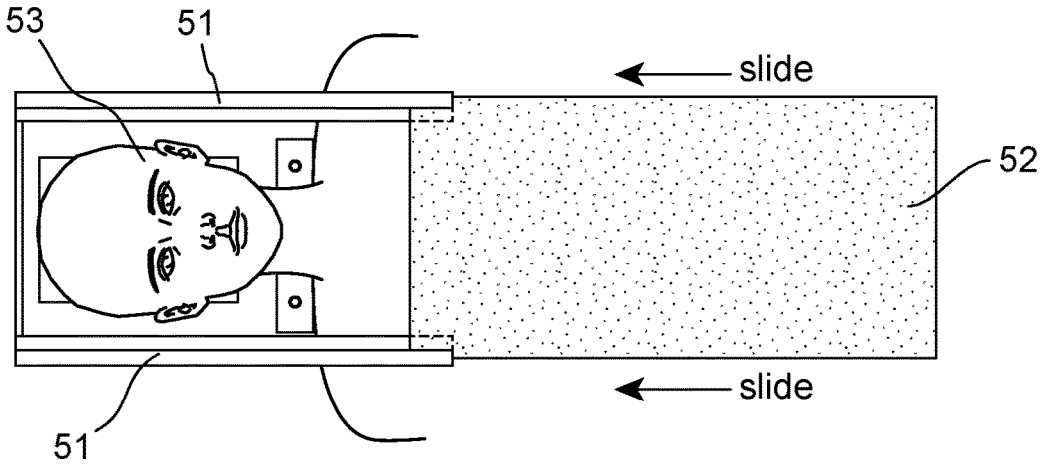
FIG. 5 shows guide rails 51 and shield 52, where the shield 52 will be positioned over the patient's face 53 when the shield 52 is slid into guide rails 51.

An exploded axonometric view of the shield and attachment means for attaching the shield to a dental chair is shown in FIG. 4. In this embodiment, the attachment means attaches the shield to a headrest adjusting mechanism of the dental chair. The plate 7 includes curved sections to accommodate the guiderails of the headrest adjusting mechanism. A different plate 7 can be used to match the headrest to account for differences in dental chair styles.

The plates 3, 6 and 7, hinge structures 4 and 5, and bolts 2 and 8 are an example of attachment means that can be used to place a shield in association of a dental chair. Depending on the dental chair, other attachment means may also be used. Similarly, when the shield is attached to a different chair or to a surgical table or bed, the attachment means may be adapted to attach the shield to the chair, surgical table, surgical bed, and the like. The use of bolts 2 provides the option of replacing only the shield part of the device if needed, while the attachment means is retained.

In certain embodiments, the shield may be slidably attached to the attachment means rather than being fixedly attached via bolts 2. For example, plate 3 may include two substantially parallel extensions sized to fit the shield therebetween. The extensions may be oppositely positioned rails where each rail enclosing a space in which the edges of the shield can be slidably positioned. See FIG. 5 which shows guide rails 51 and shield 52, where the shield 52 will be positioned over the patient's face 53 when the shield 52 is slid into guide rails 51. In certain embodiments, the slidably removable shield may be used instead of the fixedly attached shield for ease of removing and cleaning the shield or when the shield is a single use, disposable shield.

The attachment means may be made of any material suitable for this purpose. Suitable materials include steel, aluminum, hard plastic, and the like, and combinations thereof. In certain aspects, the shield and the attachment means are made of materials that can withstand sterilization, e.g., UV sterilization or sterilization by use of disinfecting solutions, and the like.

Figure 6:
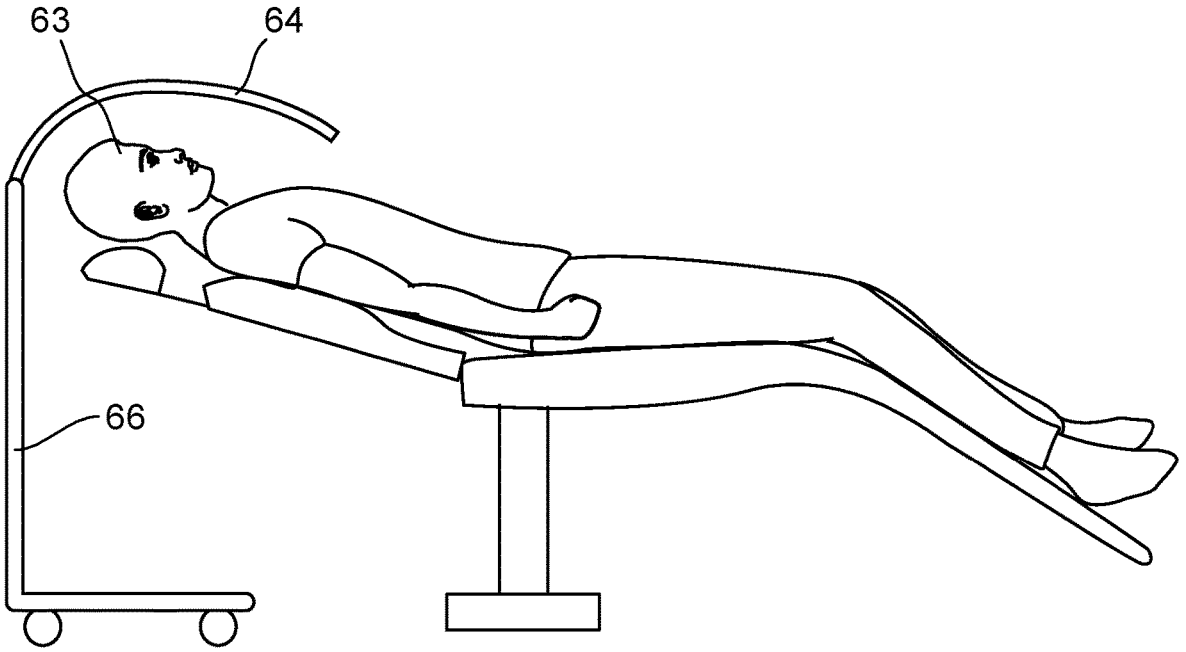
FIG. 6 provides an example of shield 64 attached to a movable tray/cart 66.

In certain embodiments, the shield is attached to a tray table, a cart, etc. In such embodiments, a hinge structure may not be included, instead the shield can be positioned over the patient's head by rolling the tray table/cart under the dental chair, operating table, etc. Such a device may be especially useful in operating rooms, e.g., for ear, nose, or throat surgery. FIG. 6 provides an example of shield 64 attached to a movable tray/cart 66. The position of the shield 64 relative to the patient's face 63 is depicted.

The shield may be shaped and sized to accommodate patients of different sizes and to accommodate instruments of different sizes. In certain embodiments, the shield may have an L-shape (see FIG. 1) when viewed from the side and substantially parallel edges. In certain embodiments, the shield may be dome shaped, e.g., roughly a hemisphere in shape. In certain embodiments, the shield may have a narrower distal region and a broader proximal region to offer a larger barrier area between the patient and the care giver.

In certain aspects, the distal region may be substantially flat with parallel edges and the proximal region may be have an oval or circular periphery.

The drape may be sized to fit around the shield and may include means for reversibly attaching to the shield. Reversible attachment means refer to attachments that can be reversed by a user without using instruments, such as, screwdriver, wrench and the like. In contrast, instruments such as screwdriver or wrench would be needed to detach the shield from the attachment means (e.g., bolts and plates) used to attach the shield to the dental chair. Reversible attachment means include adhesive surface, Velcro, electrostatic attachment, magnetic closures, or mechanical means such as snap closures. Adhesive surfaces include peel and stick adhesive strip. In certain aspects, the drape may be substantially square, rectangular, round, or oval in shape and may include a cutout shaped to fit around the periphery of the shield. The shape of the cutout may be matched to the shape of the periphery of the shield. In certain aspects, the cutout may be substantially rectangular or U-shaped to fit around the periphery of the shield depicted in the figures. The edges of the cutout may be lined with an adhesive strip covered with a tape. In use, the tape is peeled away to expose the adhesive strip which is placed at the periphery of the shield and reversibly attached to the shield. After use, the drape can be peeled off and disposed. In other embodiments, the reversible attachment means may include magnetic means, e.g., the shield may include magnets and the drape may include a metal strip. In some embodiments, the shield may include one part of a snap closure and the drape may include the complementary part of the snap closure.

In certain embodiments, the reversible attachment means (e.g., an adhesive strip) may be provided along substantially the entire periphery of the drape and used to close the open ends of the drape together and enclose the patient and part or all of the dental chair in the drape. In other embodiments, the drape may be open along the remaining edges. In some embodiments, the drape is of a length sufficient to extend to the floor.

In certain aspects, the drape may extend to the floor and/or may enclose the patient and may include an opening mated to an air filter duct that can purify the air enclosed in the drape. Such an embodiment is depicted in FIG. 1E. The air filter 130 is operably connected to the drape. In other aspects, a fan ay be used instead of an air filter to increase air circulation within the containment unit.

Figure 7:
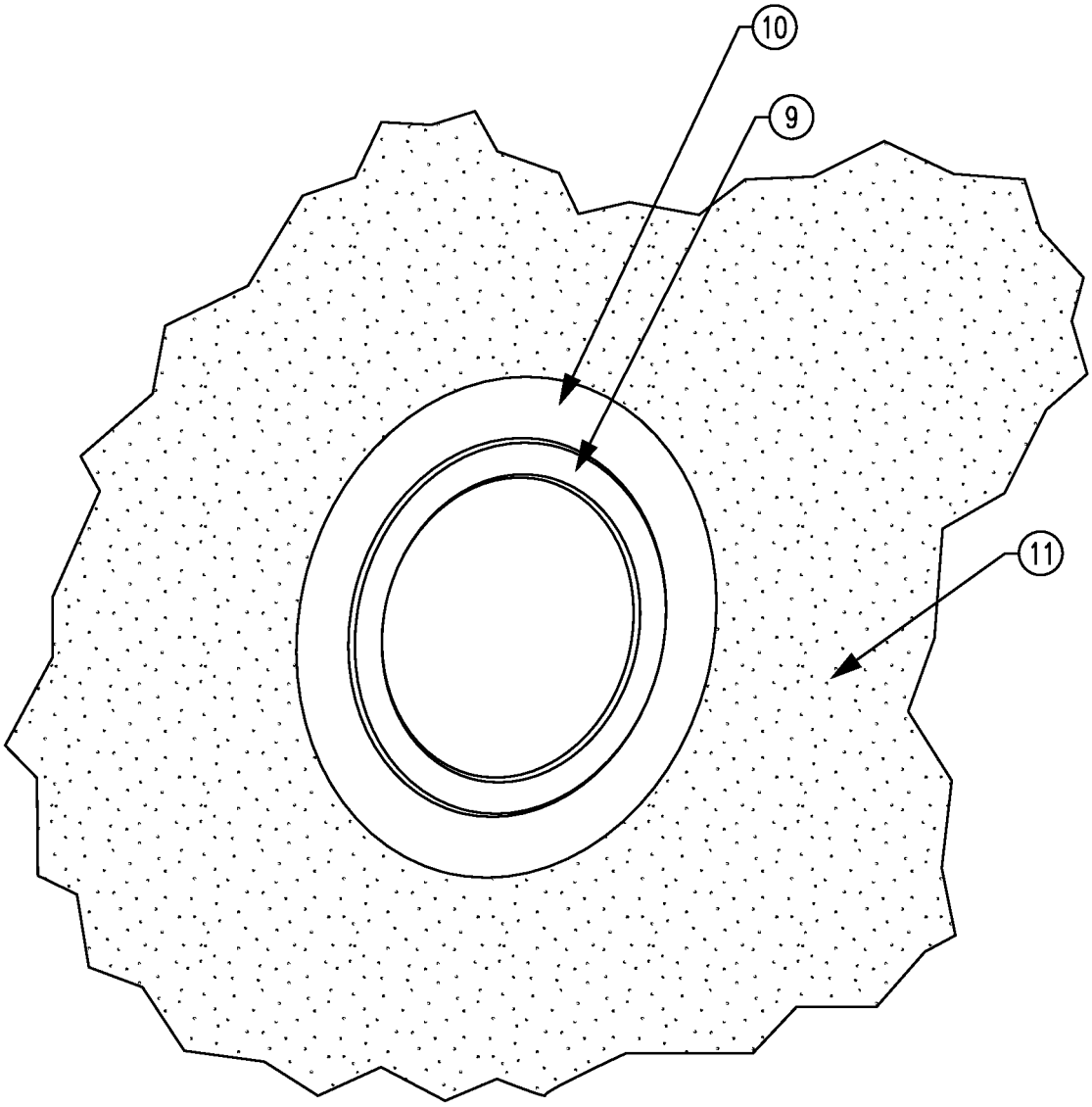
FIG. 7 depicts an opening in drape 11 lined by a PVC ring comprising a PVC plate 9 and a heat-sealable PVC plate 10.

As noted herein, the drape may include at least a pair of access regions sized to allow for passage of a hand and standard surgical/dental instruments. The access regions may be a pair of holes in the drape. In certain embodiments, the drape may include flaps that cover the holes. In use, the flap may be opened to allow access to the holes but may otherwise remain covered. In certain embodiments, opening may be a hole that is lined by a PVC ring, e.g., See FIG. 7, PVC ring 9. The PVC plate may be attached to the hole by using an outer heat sealable ring 10. The heat sealable ring may be pre-formed with the PVC ring 9 or may be separate and attached to both the PVC ring 9 and drape using heat sealing. The size of the hole may range from 120-80 mm, e.g., 100 mm.

In certain embodiments, the drape includes a pair of openings positioned in proximity to the cutout region such that the openings are adjacent to the mouth of the patient and are positioned to the left side of the patient. In certain embodiments, the pair of openings are positioned in the drape to the right side of the patient. In certain embodiments, a first pair of openings are positioned in the drape to the right side of the patient and a second pair of openings are positioned in the drape to the left side of the patient. In certain embodiments, one of pair of openings may be used for accessing the patient (e.g., for surgery, teeth cleaning, and the like) and the other pair of openings may be used for circulating air inside the shield and drape to prevent excessive fogging of the shield and/or to maintain a comfortable temperature for the patient encased in the shield and drape.

The size of the drape included in the devices disclosed herein may vary. In certain aspects, the drape size may be selected depending upon the size of the patient. For example, the drape may be of pediatric size or adult small, medium large, or extra-large size. The drape may be made of any suitable material. The drape may be disposable, single use or reusable. The drape material may be chosen based on whether it is for single use or reusable. In certain embodiments, the drape may be made from a waterproof material, e.g., surgical drape. In certain embodiments, the drape may be made of plastic, thick-woven cotton, or polyester, or combinations thereof.

While the device for reducing dissemination of aerosols and bigger droplets is described for use with a dental chair, the devices described herein can be used in other settings as well. For example, the devices can be used for eye treatment (e.g., cataract surgery, LASIK, tear duct surgery, LipiFlow® for unblocking Meibomian glands, and the like), face treatment (plastic surgery, skin treatments, and the like), as well as in the operating room where the surgery involves increased exposure of the patient's airways to the care provider.

Figure 8A:
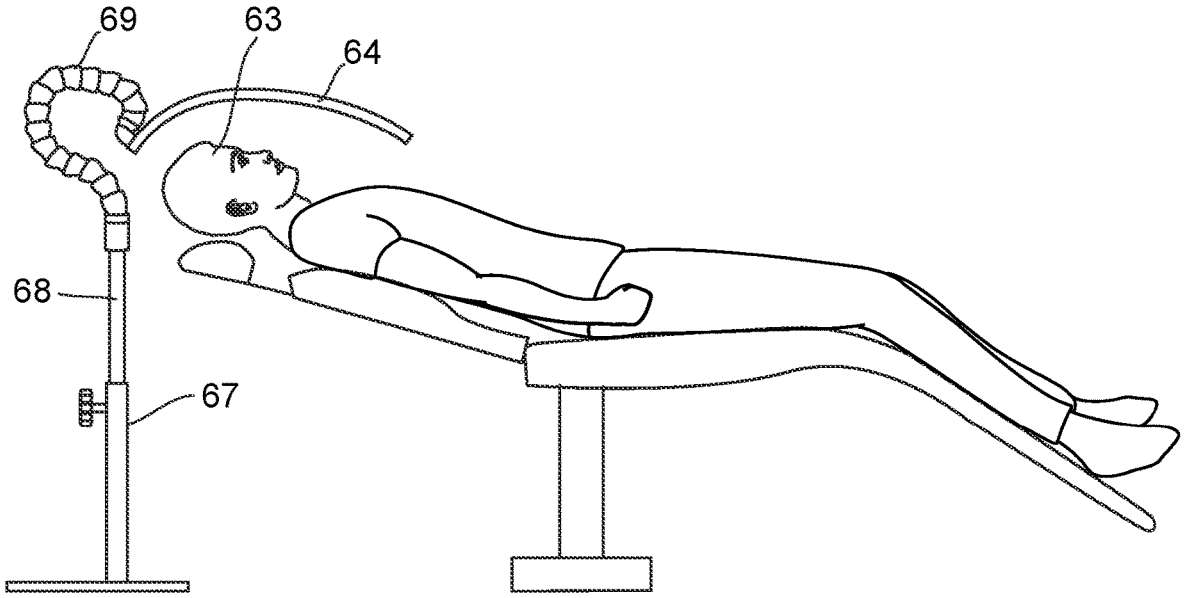
FIGS. 8A-8B illustrate various containment units provided herein.
Figure 8B:
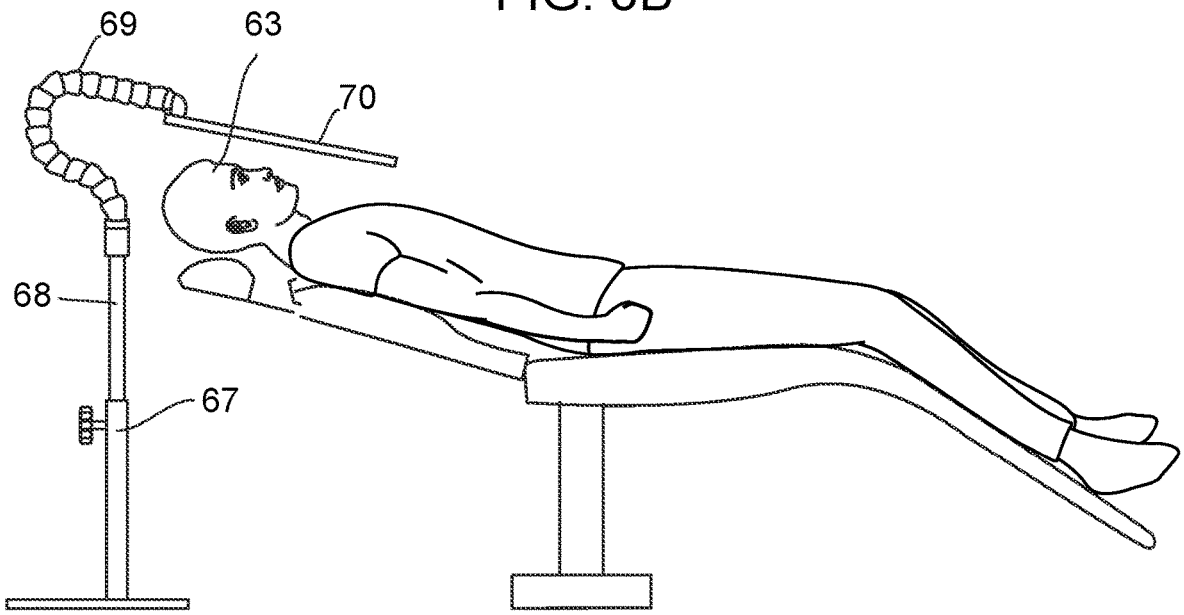

FIGS. 8A-8B and 9A-9B provide additional examples of a containment unit disclosed herein. FIG. 8A shows a platform 67 with a flat base and a hollow column with a telescoping arm 68 supported by the hollow column where the telescoping arm 68 can slide up or down relative to the hollow column. An articulating arm 69 is attached to the telescoping arm 68. A curved shield 64 (FIG. 8A) or a flat shield 70 (FIG. 8B) is attached to the articulating arm 69.

Figure 9A:
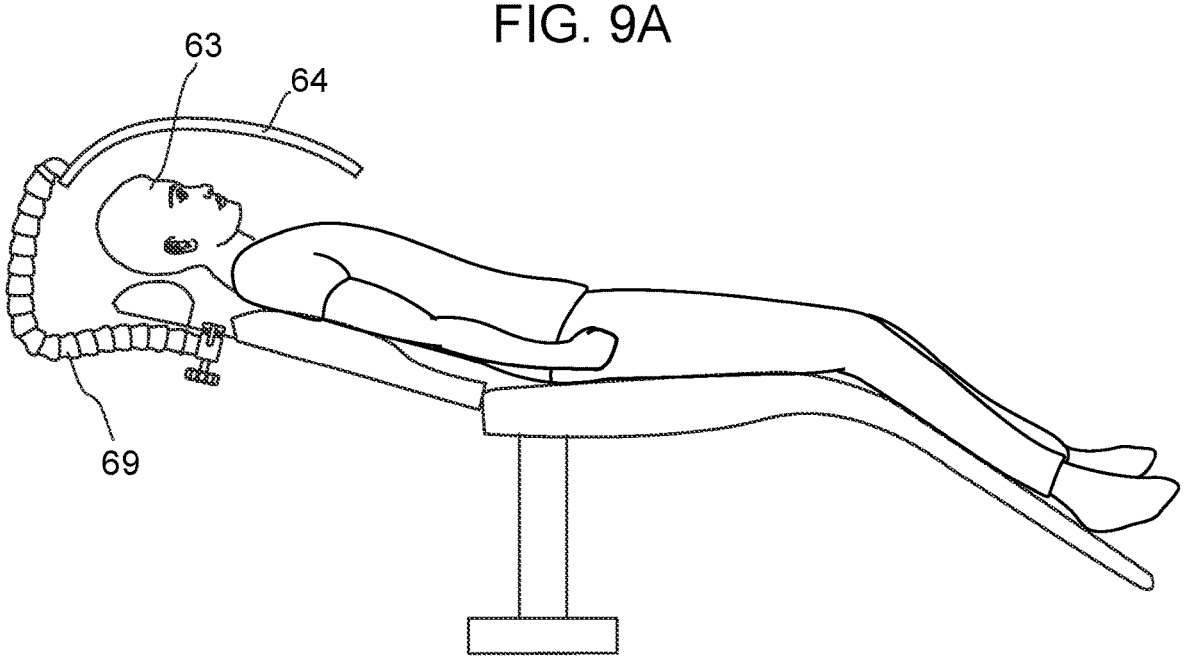
FIGS. 9A-9B illustrate additional examples of containment units provided herein.
Figure 9B:
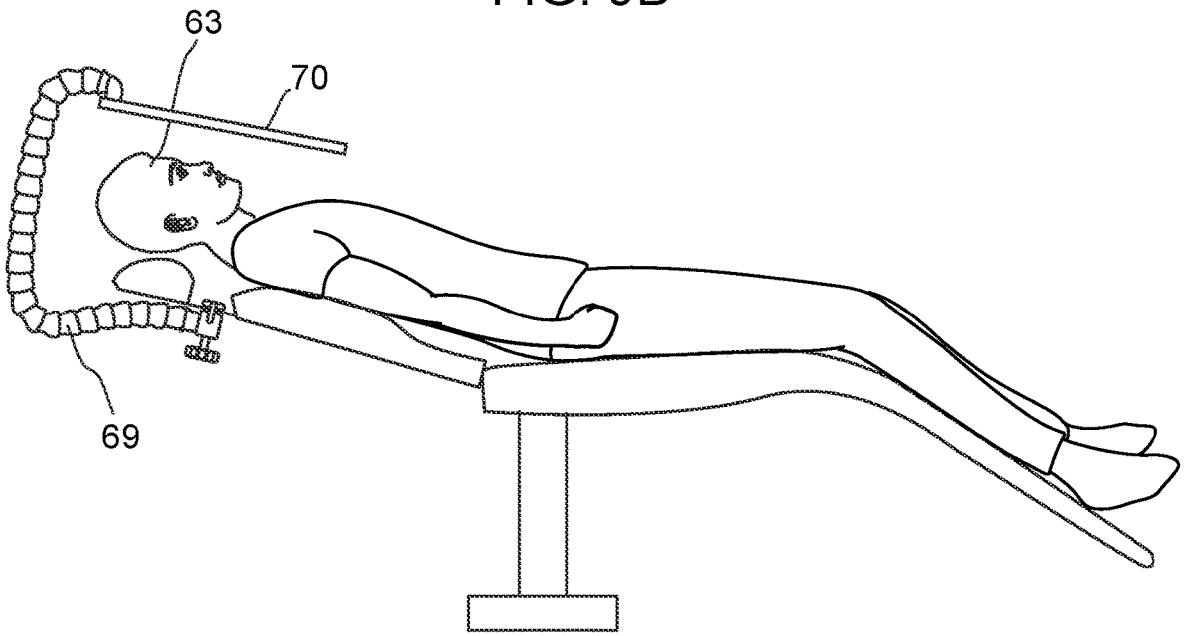

FIG. 9A shows a curved shield 64 (FIG. 9A) or a flat shield 70 (FIG. 9B) attached to a proximal end of the articulating arm 69. The distal end of the articulating arm 69 includes a clamp for attaching the articulating arm to the chair, e.g., a head rest or back rest or to a connecting member connecting the head rest and back rest.

While the present invention has been described with reference to the specific embodiments thereof, it should be understood by those skilled in the art that various changes may be made and equivalents may be substituted without departing from the true spirit and scope of the invention. In addition, many modifications may be made to adapt a particular situation, material, composition of matter, process, process step or steps, to the objective, spirit and scope of the present invention. All such modifications are intended to be within the scope of the claims appended hereto.

The invention claimed is:

1. A containment unit for limiting dissemination of nasal and/or oral droplets from a person's nasal and/or oral airways, the unit comprising:

a transparent shield sized to fit over a person's face and define a space above the person's face which space is sufficient to accommodate at least two hands and at least a skin care/eye care/surgical/dental instrument, the shield comprising a proximal end and a distal end, and a first edge and a second edge extending from the proximal end to the distal end, and a surface extending between the proximal and distal ends and between the first and second edges, wherein the proximal end, and the first and second edges define a periphery of the shield and wherein the distal end of the shield is attached to a shield-positioning assembly, wherein the shield is fixedly attached to the shield-positioning assembly, wherein the shield-positioning assembly comprises a first hinge and an attachment unit, wherein the distal end of the shield is fixedly attached to the first hinge and the attachment unit is adapted to attach the first hinge to the head rest of a chair, bed, dental chair or surgical table, wherein the first hinge is configured for rotation about a Y-axis such that the shield is positioned in an open configuration when flipped up or in a closed configuration over a patient's face when flipped down, wherein the attachment unit comprises a first plate sized to position the distal end of the shield adjacent the top end of the head rest of the chair, bed, dental chair or surgical table such that the person's head is enclosed by the surface of the shield and a drape when the drape is attached to the shield, and wherein the first plate comprises a second hinge attached to the first hinge, wherein the second hinge is rotatable about an X-axis and is configured to move the shield and the first hinge to either the left side or the right side of the chair, bed, dental chair or surgical table.

2. The containment unit according to claim 1, wherein the surface of the shield is L-shaped with a curved corner; L-shaped with a curved corner and with substantially symmetrical regions on both sides of the curved corner; C-shaped; a combination of a C-shape and an L-shape such that the surface is curved towards the distal end and substantially flat towards the proximal end; or substantially flat.

3. The containment unit according to claim 1, wherein the first and second edges are substantially parallel to each other and/or the distal and proximal ends are substantially parallel to each other.

4. The containment unit according to claim 1, wherein the attachment unit further comprises a second plate configured for attaching the first plate to a region behind the head rest of the chair, bed, dental chair or surgical table.

5. The containment unit according to claim 1, wherein the shield is slidably attached to the shield-positioning assembly, wherein the shield-positioning assembly comprises a pair of parallel guide rails configured to slidably support the shield, wherein each of the guide rails enclose a space sized to fit the length and thickness of the shield.

6. The containment unit according to claim 5, wherein the guide rails are attached to the head rest of chair, bed, dental chair or surgical table.

7. The containment unit according to claim 6, wherein the guide rails are attached to the head rest of a dental chair or a surgical table via a hinge that allows for movement of the guide rails to a position over the chair, bed, dental chair or surgical table when the guide rails are flipped down.

8. The containment unit according to claim 1, further comprising a drape attachable along the periphery of the shield and sized to cover at least the torso of the person, wherein the drape comprises at least two access areas, wherein each of the access areas is sized to accommodate passage of a hand and a skin care/eye care/surgical/dental instrument and is located at one side of the drape so as to allow for both hands to access a side of the person's face.

9. The containment unit according to claim 8, wherein the drape comprises a first pair of access areas and a second pair of access areas, wherein the first pair of access areas is located at a right side of the drape so as to allow for both hands to access the right side of the patient's face and the second pair of access areas is located at a left side of the drape so as to allow for both hands to access the left side of the person's face.

10. The containment unit according to claim 9, wherein drape comprises a proximal end comprising a cut-out shaped to match the shape of the periphery of the shield and wherein when the cut-out is rectangular in shape and the periphery of the shield is rectangular, or wherein when the cut-out is square in shape and the periphery of the shield is square in shape, or wherein when the cut-out is oval in shape and the periphery of the shield is oval in shape.

11. The containment unit according to claim 8, wherein the drape is sized to extend from the shield to at least the side edges of the chair, bed, dental chair, or surgical table; wherein the drape is sized to extend from the shield to the floor and covering at least a top half of the chair, bed, dental chair, or surgical table; or wherein the drape is sized to extend from the shield to the floor and cover substantially the entire chair, bed, dental chair, or surgical table.

12. The containment unit according to claim 8, wherein the drape comprises a material substantially impermeable to aerosols and droplets.

13. The containment unit according to claim 8, wherein the access regions comprise holes lined with a material to provide structural support to the holes.

* * * * *